US010490329B2

(12) United States Patent
Eguchi et al.

(10) Patent No.: US 10,490,329 B2
(45) Date of Patent: Nov. 26, 2019

(54) SUPERCONDUCTING MAGNET

(71) Applicant: MITSUBISHI ELECTRIC CORPORATION, Chiyoda-ku, Tokyo (JP)

(72) Inventors: Ryo Eguchi, Tokyo (JP); Hajime Tamura, Tokyo (JP); Tatsuya Inoue, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 154 days.

(21) Appl. No.: 15/555,127

(22) PCT Filed: Apr. 10, 2015

(86) PCT No.: PCT/JP2015/061196
§ 371 (c)(1),
(2) Date: Sep. 1, 2017

(87) PCT Pub. No.: WO2016/163021
PCT Pub. Date: Oct. 13, 2016

(65) Prior Publication Data

US 2018/0040402 A1 Feb. 8, 2018

(51) Int. Cl.
*H01F 1/00* (2006.01)
*H01F 6/04* (2006.01)
(Continued)

(52) U.S. Cl.
CPC ..... *H01F 6/04* (2013.01); *H01F 6/02* (2013.01); *H01F 6/06* (2013.01)

(58) Field of Classification Search
CPC .... H01F 6/04; H01F 6/06; H01F 6/02; G01K 13/00; G01M 1/38; G01V 3/00
(Continued)

(56) References Cited

U.S. PATENT DOCUMENTS 6,107,905 A * 8/2000 Itoh ..... F17C 3/085 335/216
6,230,499 B1 * 5/2001 Hohne ..... F25B 9/145 374/E17.003
(Continued)

FOREIGN PATENT DOCUMENTS

CN 1684207 A 10/2005
EP 1 587 114 A2 10/2005
(Continued)

OTHER PUBLICATIONS

Office Action dated Nov. 14, 2018, by the Chinese Patent Office in corresponding Chinese Patent Application No. 201580078310.8 and English translation of the Office Action. (8 pages).
(Continued)

*Primary Examiner* — Shawki S Ismail
*Assistant Examiner* — Lisa N Homza
(74) *Attorney, Agent, or Firm* — Buchanan Ingersoll & Rooney PC

(57) ABSTRACT

A superconducting magnet includes: a superconducting coil; a coolant container; a radiation shield; a vacuum container; a refrigerator configured to cool the inner part of the coolant container and the radiation shield; a first exhaust pipe connected to the coolant container from the outside of the vacuum container and serving as a flow path of the coolant vaporized; a first pressure release valve connected to a distal end of the first exhaust pipe outside the vacuum container and configured to open when a pressure in the coolant container becomes a first set value or higher; a heater provided at the first exhaust pipe and configured to heat the first exhaust pipe; and a detector provided at the first exhaust pipe and configured to detect a change due to occurrence of freezing in the first exhaust pipe.

12 Claims, 4 Drawing Sheets

(51) Int. Cl.
*H01F 6/02* (2006.01)
*H01F 6/06* (2006.01)

(58) Field of Classification Search
USPC ..... 335/216; 324/318; 700/275
See application file for complete search history.

(56) References Cited

U.S. PATENT DOCUMENTS 8,923,939 B2 * 12/2014 Kawashima ..... H01F 6/04 505/163
10,203,068 B2 * 2/2019 Strobel ..... F17C 3/085
2002/0024338 A1 * 2/2002 Saho ..... F17C 3/085 324/248
2004/0017117 A1 * 1/2004 Kwon ..... F25B 9/145 310/61
2004/0056541 A1 * 3/2004 Steinmeyer ..... F28D 15/0266 310/52
2005/0262851 A1 * 12/2005 Atrey ..... F25D 19/00 62/6
2006/0097146 A1 * 5/2006 Strobel ..... F25B 9/02 250/286
2006/0230769 A1 * 10/2006 Nogami ..... G01R 33/3815 62/129
2008/0290869 A1 * 11/2008 Hutton ..... G01R 33/30 324/318
2009/0007573 A1 * 1/2009 Noonan ..... F25B 17/08 62/51.1
2009/0224862 A1 * 9/2009 Mikheev ..... H01F 6/04 335/216
2010/0236260 A1 * 9/2010 Roth ..... H01F 6/04 62/51.1
2010/0313574 A1 * 12/2010 Koyanagi ..... F25D 19/006 62/3.1
2012/0094840 A1 * 4/2012 Tanaka ..... H01F 6/006 505/211
2015/0007586 A1 * 1/2015 Kraus ..... G01R 33/3815 62/51.1
2016/0369946 A1 * 12/2016 Tago ..... H01F 6/04
2017/0200541 A1 * 7/2017 Inoue ..... H01F 6/02

FOREIGN PATENT DOCUMENTS

EP 1 587 114 A3 10/2005
JP 9-64425 A 3/1997
JP 2005-203704 A 7/2005
JP 2005-310811 A 11/2005
JP 2006-222417 A 8/2006
JP 2008-154677 A 7/2008
JP 2009-146934 A 7/2009

OTHER PUBLICATIONS

International Search Report (PCT/ISA/210) dated Jun. 30, 2015, by the Japanese Patent Office as the International Searching Authority for International Application No. PCT/JP2015/061196.

* cited by examiner

SUPERCONDUCTING MAGNET

TECHNICAL FIELD

The present invention relates to a superconducting magnet and particularly to a superconducting magnet including a superconducting coil to be cooled by being immersed in coolant.

BACKGROUND ART

One of the prior documents that disclose a configuration of a superconducting magnet is Japanese Patent Laying-Open No. 2005-310811 (PTD 1). The superconducting magnet described in PTD 1 includes a coil container containing a superconducting coil and containing liquefied coolant to cool the superconducting coil to a critical point or less, a vacuum container enclosing the coil container for vacuum insulation of the coil container from outside, and an exhaust pipe having one end communicating with the inside of the coil container and the other end lying outside the vacuum container, where the exhaust pipe is provided with a heating means to heat the exhaust pipe, the heating means being provided on at least one area of the exhaust pipe laid inside the vacuum container.

CITATION LIST

Patent Document

PTD 1: Japanese Patent Laying-Open No. 2005-310811

SUMMARY OF INVENTION

Technical Problem

In the superconducting magnet described in PTD 1, an increase in pressure in the exhaust pipe due to clogging of the exhaust pipe is detected, and when a pressure in the exhaust pipe becomes a set value or higher, the heater is energized to heat the exhaust pipe. When freezing has progressed to such an extent as to cause clogging of the exhaust pipe and the exhaust pipe is heated to melt the freezing portion, a relatively long heating time is required. If quench or vacuum break occurs during the heating time, the use of the superconducting magnet has to be interrupted.

The present invention has been made in view of the above problem and aims to provide a superconducting magnet where an exhaust pipe can be prevented from getting clogged up.

Solution to Problem

A superconducting magnet according to the present invention includes: a superconducting coil; a coolant container containing the superconducting coil in a state where the superconducting coil is immersed in liquid coolant; a radiation shield surrounding the coolant container; a vacuum container containing the superconducting coil, the coolant container, and the radiation shield; a refrigerator configured to cool the inner part of the coolant container and the radiation shield; a first exhaust pipe connected to the coolant container from the outside of the vacuum container and serving as a flow path of the coolant vaporized; a first pressure release valve connected to a distal end of the first exhaust pipe outside the vacuum container and configured to open when a pressure in the coolant container becomes a first set value or higher; a heater provided at the first exhaust pipe and configured to heat the first exhaust pipe; and a detector provided at the first exhaust pipe and configured to detect a change due to occurrence of freezing in the first exhaust pipe.

Advantageous Effects of Invention

According to the present invention, a change due to occurrence of freezing in an exhaust pipe can be detected with a detector, and the exhaust pipe can be heated with a heater before getting clogged up. Therefore, the exhaust pipe can be prevented from getting clogged up.

DESCRIPTION OF EMBODIMENTS

Hereinafter superconducting magnets according to embodiments of the present invention are described with reference to the figures. In the description of the embodiments below, identical or equivalent parts are identically denoted in the figures and explanations thereof are not repeated. Note that although a description of a cylindrical superconducting magnet is given in the following embodiments, the present invention is not necessarily limited to a cylindrical superconducting magnet but may also be applied to an open superconducting magnet.

Embodiment 1

Figure 1:
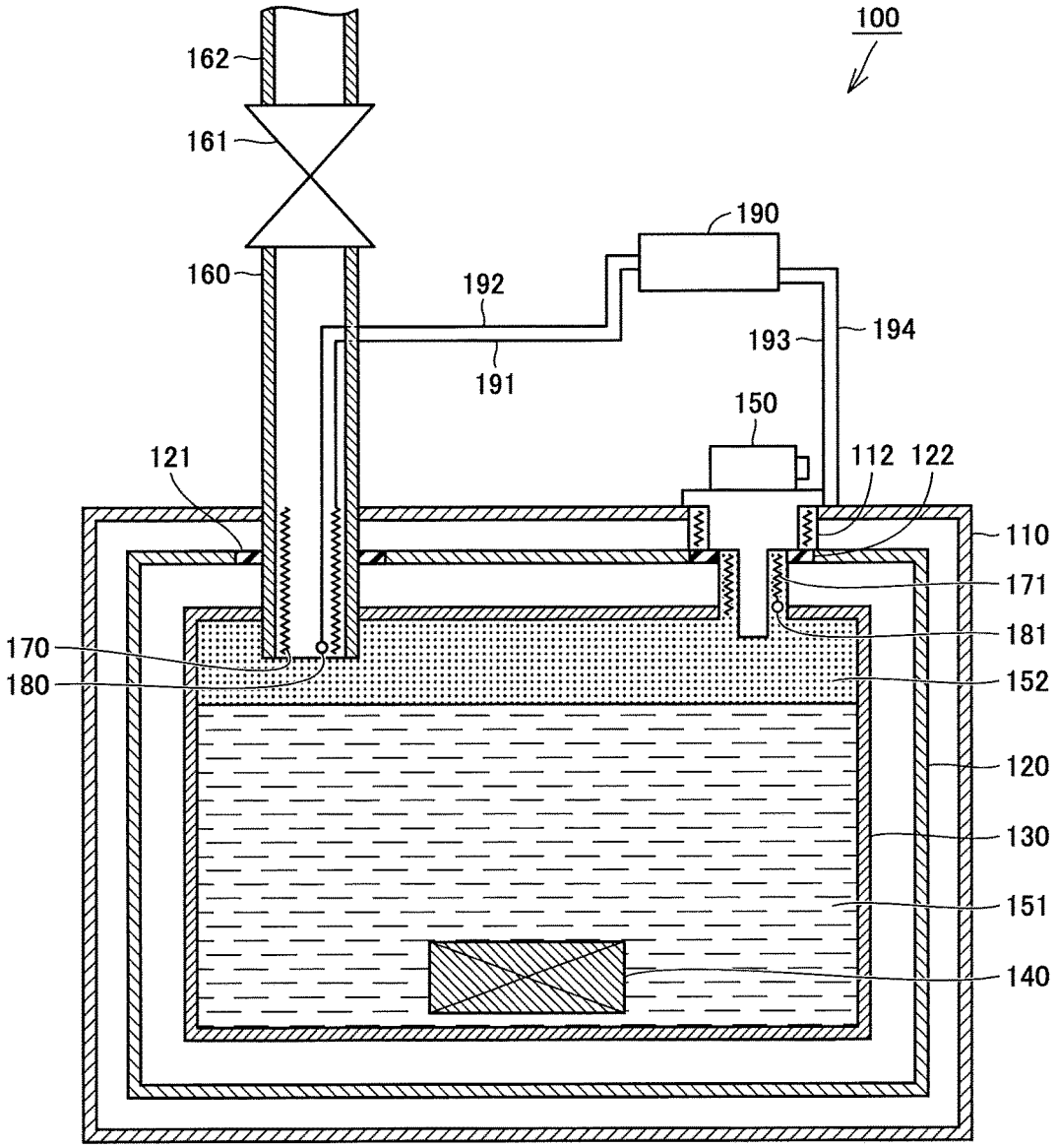
FIG. 1 is a cross-sectional view showing a configuration of a superconducting magnet according to Embodiment 1 of the present invention.

FIG. 1 is a cross-sectional view showing a configuration of a superconducting magnet according to Embodiment 1 of the present invention. FIG. 1 shows a cross section of only the upper part of a superconducting magnet 100. In FIG. 1, the components are shown in a simplified form for the sake of simplicity.

As shown in FIG. 1, in superconducting magnet 100 according to Embodiment 1 of the present invention, a hollow cylindrical vacuum container 110 is disposed on the outermost side. Vacuum container 110 is formed of, for example, a non-magnetic material such as stainless-steel or aluminum for vacuum insulation between the inner and outer sides of vacuum container 110. The inside of vacuum container 110 is reduced in pressure by a pressure reducing device (not shown) to form a vacuum.

In vacuum container 110, a hollow cylindrical radiation shield 120 is disposed that is substantially similar to vacuum container 110 in shape. Radiation shield 120 is formed of, for example, a non-magnetic material having a high light reflectance, such as aluminum. A multi-layer heat insulating material (superinsulation), which is not shown, is attached to a surface of radiation shield 120.

In radiation shield 120, a hollow cylindrical coolant container 130 is disposed that is substantially similar to radiation shield 120 in shape. Radiation shield 120 serves as a heat insulator between coolant container 130 and vacuum container 110 as surrounding coolant container 130. Coolant container 130 is formed of a non-magnetic material such as stainless-steel or aluminum.

In coolant container 130, a superconducting coil 140 is contained. Superconducting coil 140 is wound around the bottom portion of coolant container 130 which also serves as a reel. The inside of coolant container 130 is filled with liquid helium 151 which is liquid coolant. Superconducting coil 140 is cooled as being immersed in liquid helium 151. Superconducting coil 140 is made up, for example, by winding a superconducting wire formed of a copper matrix with a niobium-titanium alloy embedded in its center part.

Vacuum container 110 thus contains superconducting coil 140, coolant container 130, and radiation shield 120.

Superconducting magnet 100 further includes a refrigerator 150 to cool the inner part of coolant container 130 and radiation shield 120. A Gifford-McMahon refrigerator or a pulse tube refrigerator each having two refrigeration stages may be used as refrigerator 150.

Refrigerator 150 is inserted in a cylinder 112 extending from vacuum container 110 to coolant container 130. A first refrigeration stage of refrigerator 150 is indirectly in contact with radiation shield 120 with a thermal anchor 122 of cylinder 112 interposed therebetween. A second refrigeration stage of refrigerator 150 lies in the upper part in coolant container 130 and re-liquefies vaporized helium gas 152.

A first space is defined between the outer periphery of the first refrigeration stage of refrigerator 150 and the inner periphery of cylinder 112. A second space is defined between the outer periphery of the second refrigeration stage of refrigerator 150 and the inner periphery of cylinder 112. The first space and the second space are in communication with each other through a path (not shown).

Superconducting magnet 100 further includes a first exhaust pipe 160 extending from the outside of vacuum container 110 through to the inside of coolant container 130 and serving as a flow path of helium gas 152. A proximal end portion of first exhaust pipe 160 is connected to coolant container 130. First exhaust pipe 160 is formed of a non-magnetic material such as stainless-steel or aluminum.

First exhaust pipe 160 is fixed to vacuum container 110. First exhaust pipe 160 is indirectly in contact with radiation shield 120 with a thermal anchor 121 interposed therebetween. The proximal end portion of first exhaust pipe 160 is cooled to around 4 K, substantially the same as a temperature of superconducting coil 140. The outside of vacuum container 110 is at a room temperature around 300 K.

Superconducting magnet 100 further includes a first pressure release valve 161 that is connected to a distal end of first exhaust pipe 160 outside vacuum container 110 and that opens when a pressure in coolant container 130 becomes a first set value or higher. As first pressure release valve 161, a check valve or a solenoid valve may be used, for example. The first set value is, for example, 1000 Pa.

Superconducting magnet 100 further includes a first heater 170 provided at first exhaust pipe 160 to heat first exhaust pipe 160. First heater 170 is a resistive heater and is provided along a portion of the inner periphery of first exhaust pipe 160 lying inside vacuum container 110. First heater 170 is in the form of a mesh, a sheet, or a wire.

In the present embodiment, superconducting magnet 100 further includes a second heater 171 provided at cylinder 112 to heat cylinder 112. Second heater 171 is a resistive heater and is provided along the inner periphery of cylinder 112 or the outer periphery of refrigerator 150. Second heater 171 is disposed in each of the first and second spaces described above. Second heater 171 is in the form of a mesh, a sheet, or a wire. Second heater 171 does, not necessarily have to be provided and may be provided only in the second space.

Superconducting magnet 100 further includes a first detector 180 provided at first exhaust pipe 160 to detect a change due to occurrence of freezing in first exhaust pipe 160. In the present embodiment, first detector 180 is disposed inside first exhaust pipe 160.

First detector 180 includes a pair of terminals (not shown) and detects a change in potential difference between the paired terminals due to occurrence of freezing in first exhaust pipe 160. Specifically, first detector 180 detects a decrease in potential difference between the paired terminals when a freezing portion generated in first exhaust pipe 160 adheres to the paired terminals and causes a short circuit between the terminals.

In the present embodiment, first detector 180 is disposed near the proximal end portion of first exhaust pipe 160 where freezing easily occurs because of its low temperature. The location of first detector 180, however, is not limited to this. First detector 180 may be disposed, for example, at a portion inside first exhaust pipe 160 where first exhaust pipe 160 is in contact with thermal anchor 121 of radiation shield 120. Although not shown, the portion inside first exhaust pipe 160 where first exhaust pipe 160 is in contact with thermal anchor 121 is partially narrowed, which makes this portion easily generate freezing. First detector 180 may be disposed outside vacuum container 110, with only the paired terminals of first detector 180 disposed inside first exhaust pipe 160.

In the present embodiment, superconducting magnet 100 further includes a second detector 181 provided at cylinder 112 to detect a change due to occurrence of freezing in cylinder 112. Second detector 181 is disposed inside cylinder 112. Second detector 181 includes a pair of terminals (not shown) and detects a change in potential difference between the paired terminals due to occurrence of freezing in cylinder 112. Specifically, second detector 181 detects a decrease in potential difference between the paired terminals when a freezing portion generated in cylinder 112 adheres to the paired terminals and causes a short circuit between the terminals. Second detector 181 does not necessarily have to be provided.

Superconducting magnet 100 further includes a controller 190 electrically connected to each of first heater 170, second heater 171, first detector 180, and second detector 181. Controller 190 is disposed outside vacuum container 110. Controller 190 and first heater 170 are electrically connected to each other with a first line 191. Controller 190 and first detector 180 are electrically connected to each other with a second line 192. Controller 190 and second heater 171 are electrically connected to each other with a third line 193. Controller 190 and second detector 181 are electrically connected to each other with a fourth line 194. In FIG. 1, a part of each of third line 193 and fourth line 194 is not shown for the sake of simplicity.

To controller 190, an output signal of each of first detector 180 and second detector 181 is input. Controller 190 causes first heater 170 to work while controller 190 is receiving input of a signal output from first detector 180 detecting a decrease in potential difference between the paired terminals. Controller 190 causes second heater 171 to work while controller 190 is receiving input of a signal output from second detector 181 detecting a decrease in potential difference between the paired terminals.

Now the operation of superconducting magnet 100 is described.

If a pressure in coolant container 130 becomes 1000 Pa or higher, first pressure release valve 161 opens for helium gas 152 to be released to first external pipe 162. If a pressure in coolant container 130 becomes lower than 1000 Pa, first pressure release valve 161 closes. In some cases, however, air intrudes from first external pipe 162 into first exhaust pipe 160 before first pressure release valve 161 closes.

Moisture in the air that has intruded into first exhaust pipe 160 is cooled to freeze in first exhaust pipe 160. If the freezing portion adheres to the paired terminals of first detector 180 and causes a short circuit between the terminals, a potential difference between the paired terminals is decreased. First detector 180 which has detected a decrease in potential difference between the paired terminals inputs an output signal to controller 190.

While controller 190 is receiving input of an output signal from first detector 180, controller 190 causes first heater 170 to work to melt the freezing portion in first exhaust pipe 160. Water generated by melting the freezing portion drops into coolant container 130. This resolves the short circuit between the terminals and restores a potential difference between the paired terminals. As a result, output of the signal from first detector 180 stops. When input of the output signal from first detector 180 stops, then controller 190 causes first heater 170 to stop working.

As described above, superconducting magnet 100 according to the present embodiment can melt a freezing portion in first exhaust pipe 160 before the freezing progresses to such an extent as to clog up first exhaust pipe 160. First exhaust pipe 160 can thus be prevented from getting clogged up.

As described above, in some cases, moisture in the air that has intruded into first exhaust pipe 160 freezes in the first and second spaces. In this case, cooling efficiency of refrigerator 150 is reduced. If a freezing portion generated in the second space adheres to the paired terminals of second detector 181 and causes a short circuit between the terminals, a potential difference between the paired terminals is decreased. Second detector 181 which has detected the decrease in potential difference between the paired terminals inputs an output signal to controller 190.

While controller 190 is receiving input of the output signal from second detector 181, controller 190 causes second heater 171 to work to melt the freezing portion in the first space and in the second space. Water generated by melting the freezing portion drops into coolant container 130. This resolves the short circuit between the terminals and restores a potential difference between the paired terminals. As a result, output of the signal from second detector 181 stops. When input of the output signal from second detector 181 stops, then controller 190 causes second heater 171 to stop working.

As described above, superconducting magnet 100 according to the present embodiment can melt a freezing portion in the first and second spaces before the freezing progresses to such an extent as to clog up the first and second spaces. The first and second spaces can thus be prevented from getting clogged up. Accordingly, cooling efficiency of refrigerator 150 can be maintained.

In superconducting magnet 100 according to the present embodiment, first heater 170 is disposed inside first exhaust pipe 160. The embodiment is, however, not limited as such, but first heater 170 may be disposed, for example, along a portion of the outer periphery of first exhaust pipe 160 lying inside vacuum container 110. In this case, however, a freezing portion is heated through first exhaust pipe 160. Thus, first heater 170 disposed inside first exhaust pipe 160 would be able to heat a freezing portion more efficiently.

Although second heater 171 is disposed inside cylinder 112, the present embodiment is not limited as such, but second heater 171 may be disposed, for example, along the outer periphery of cylinder 112. In this case, however, a freezing portion is heated through cylinder 112. Thus, second heater 171 disposed inside cylinder 112 would be able to heat a freezing portion more efficiently.

In superconducting magnet 100 according to the present embodiment, each of first detector 180 and second detector 181 detects a change in potential difference between the paired terminals. The embodiment is, however, not limited as such, but each of first detector 180 and second detector 181 may detect, for example, a change in thermal conductivity based on a difference between a thermal conductivity of the water or nitrogen contained in the air and a thermal conductivity of the helium gas. For example, an ice detector for an unmanned aerial vehicle, Model 9732-UAV, manufactured by New Avionics Corporation (USA) may be used as each of first detector 180 and second detector 181 to detect a moisture or nitrogen component.

Hereinafter a superconducting magnet according to Embodiment 2 of the present invention is described. A superconducting magnet 200 according to the present embodiment is different from superconducting magnet 100 according to Embodiment 1 only in that superconducting magnet 200 is provided with a connection pipe 260 connecting first exhaust pipe 160 with cylinder 112. Explanations of other features are not repeated.

Embodiment 2

Figure 2:
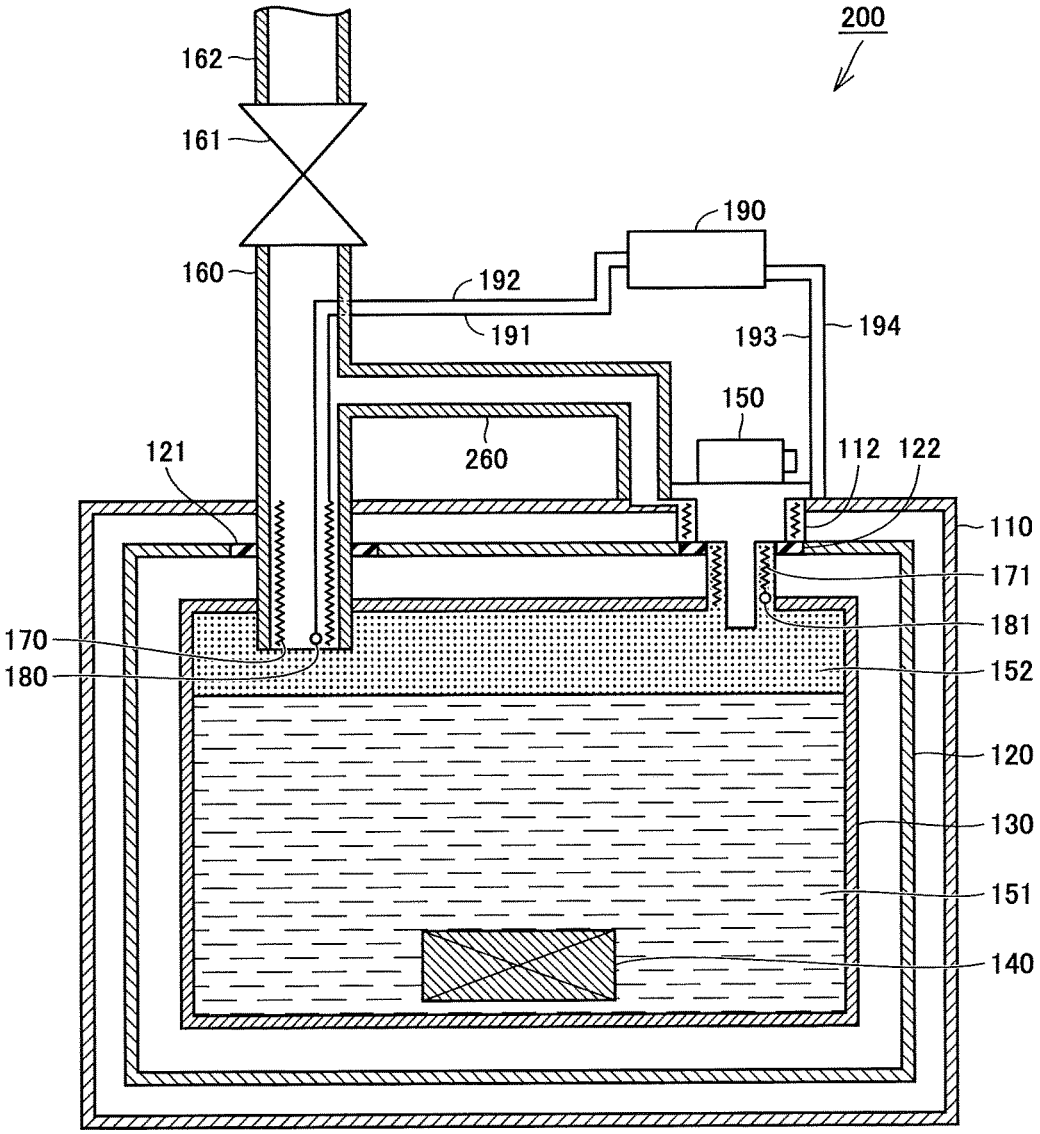
FIG. 2 is a cross-sectional view showing a configuration of a superconducting magnet according to Embodiment 2 of the present invention.

FIG. 2 is a cross-sectional view showing a configuration of a superconducting magnet according to Embodiment 2 of the present invention. FIG. 2 shows a cross section of only the upper part of superconducting magnet 200. In FIG. 2, the components are shown in a simplified form for the sake of simplicity.

As shown in FIG. 1, in superconducting magnet 200 according to Embodiment 2 of the present invention, first exhaust pipe 160 and cylinder 112 are connected to each other with connection pipe 260. The inner part of first exhaust pipe 160 and the inner part of cylinder 112 are in communication with each other through connection pipe 260.

In superconducting magnet 200 according to the present embodiment, when first pressure release valve 161 opens and helium gas 152 is released to first external pipe 162, part of helium gas 152 passes through the inner parts of cylinder 112, connection pipe 260, and first exhaust pipe 160 in order. At this time, if refrigerator 150 is not working, refrigerator 150 can be cooled by helium gas 152 passing through the inner part of cylinder 112. This can prevent heat from intruding into coolant container 130 through refrigerator 150. Thus, further vaporization of liquid helium 151 can be prevented.

Hereinafter a superconducting magnet according to Embodiment 3 of the present invention is described. A superconducting magnet 300 according to the present embodiment is different from superconducting magnet 100 according to Embodiment 1 mainly in that superconducting magnet 300 is provided with a second exhaust pipe 360. The features similar to those of superconducting magnet 100 according to Embodiment 1 are identically denoted and explanations thereof are not repeated.

Embodiment 3

Figure 3:
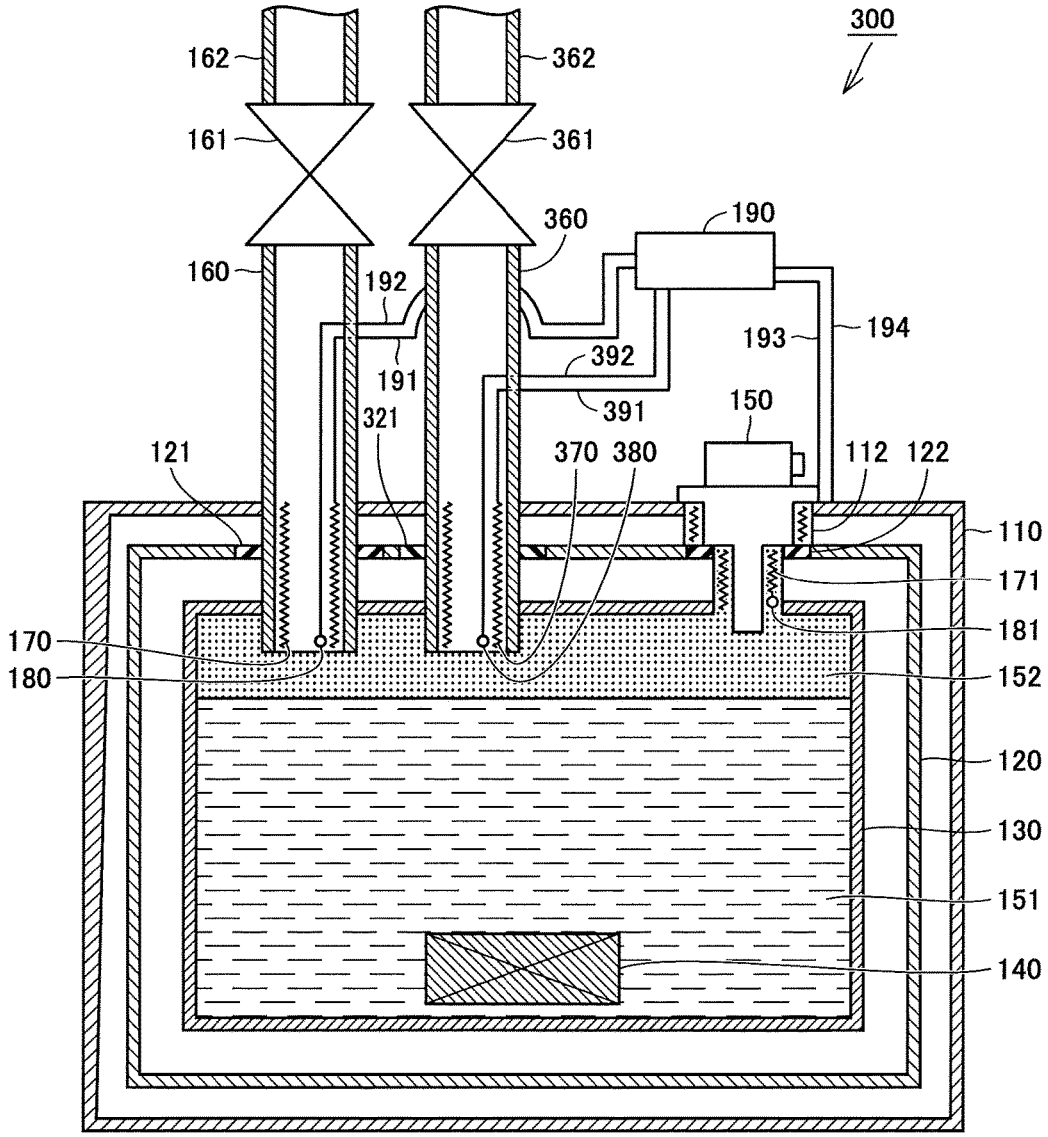
FIG. 3 is a cross-sectional view showing a configuration of a superconducting magnet according to Embodiment 3 of the present invention.

FIG. 3 is a cross-sectional view showing a configuration of a superconducting magnet according to Embodiment 3 of the present invention. FIG. 3 shows a cross section of only the upper part of superconducting magnet 300. In FIG. 3, the components are shown in a simplified form for the sake of simplicity.

As shown in FIG. 3, superconducting magnet 300 according to Embodiment 3 of the present invention further includes second exhaust pipe 360 extending from the outside of vacuum container 110 through to the inside of coolant container 130 and serving as a flow path of helium gas 152. Second exhaust pipe 360 is aligned with first exhaust pipe 160. A proximal end portion of second exhaust pipe 360 is connected to coolant container 130. Second exhaust pipe 360 is formed of a non-magnetic material such as stainless-steel or aluminum.

Second exhaust pipe 360 is fixed to vacuum container 110. Second exhaust pipe 360 is indirectly in contact with radiation shield 120 with a thermal anchor 321 interposed therebetween. The proximal end portion of second exhaust pipe 360 is cooled to around 4 K, substantially the same as a temperature of superconducting coil 140.

Superconducting magnet 300 further includes a second pressure release valve 361 that is connected to a distal end of second exhaust pipe 360 outside vacuum container 110 and that opens when a pressure in coolant container 130 becomes a second set value or higher, the second set value being higher than the first set value. As second pressure release valve 361, a check valve or a solenoid valve may be used, for example. The second set value is, for example, 2000 Pa. Second pressure release valve 361 and second exhaust pipe 360 are provided in case of a malfunction during which first pressure release valve 161 fails to work.

Superconducting magnet 300 further includes a third heater 370 provided at second exhaust pipe 360 to heat second exhaust pipe 360. Third heater 370 is a resistive heater and is provided along a portion of the inner periphery of second exhaust pipe 360 lying inside vacuum container 110. Third heater 370 is in the form of a mesh, a sheet, or a wire.

Superconducting magnet 300 further includes a third detector 380 provided at second exhaust pipe 360 to detect a change due to occurrence of freezing in second exhaust pipe 360. In the present embodiment, third detector 380 is disposed inside second exhaust pipe 360.

Third detector 380 includes a pair of terminals (not shown) and detects a change in potential difference between the paired terminals due to occurrence of freezing in second exhaust pipe 360. Specifically, third detector 380 detects a decrease in potential difference between the paired terminals when a freezing portion generated in second exhaust pipe 360 adheres to the paired terminals and causes a short circuit between the terminals.

In the present embodiment, third detector 380 is disposed near the proximal end portion of second exhaust pipe 360 where freezing easily occurs because of its low temperature. The location of third detector 380, however, is not limited to this. Third detector 380 may be disposed, for example, at a portion inside second exhaust pipe 360 where second exhaust pipe 360 is in contact with thermal anchor 121 of radiation shield 120. Although not shown, the portion inside second exhaust pipe 360 where second exhaust pipe 360 is in contact with thermal anchor 121 is partially narrowed, which makes this portion easily generate freezing. Third detector 380 may be disposed outside vacuum container 110, with only the paired terminals of third detector 380 disposed inside second exhaust pipe 360.

Controller 190 is electrically connected to third heater 370 with a fifth line 391. Controller 190 is electrically connected to third detector 380 with a sixth line 392. To controller 190, an output signal of third detector 380 is input. Controller 190 causes third heater 370 to work while controller 190 is receiving input of a signal output from third detector 380 detecting a decrease in potential difference between the paired terminals.

Superconducting magnet 300 according to the present embodiment can melt a freezing portion in second exhaust pipe 360 before the freezing progresses to such an extent as to clog up second exhaust pipe 360. Second exhaust pipe 360 can thus be prevented from getting clogged up.

Hereinafter a superconducting magnet according to Embodiment 4 of the present invention is described. A superconducting magnet 400 according to the present embodiment is different from superconducting magnet 300 according to Embodiment 3 mainly in structure of the first exhaust pipe and in feature of the detector. The features similar to those of superconducting magnet 300 according to Embodiment 3 are identically denoted and explanations thereof are not repeated.

Embodiment 4

Figure 4:
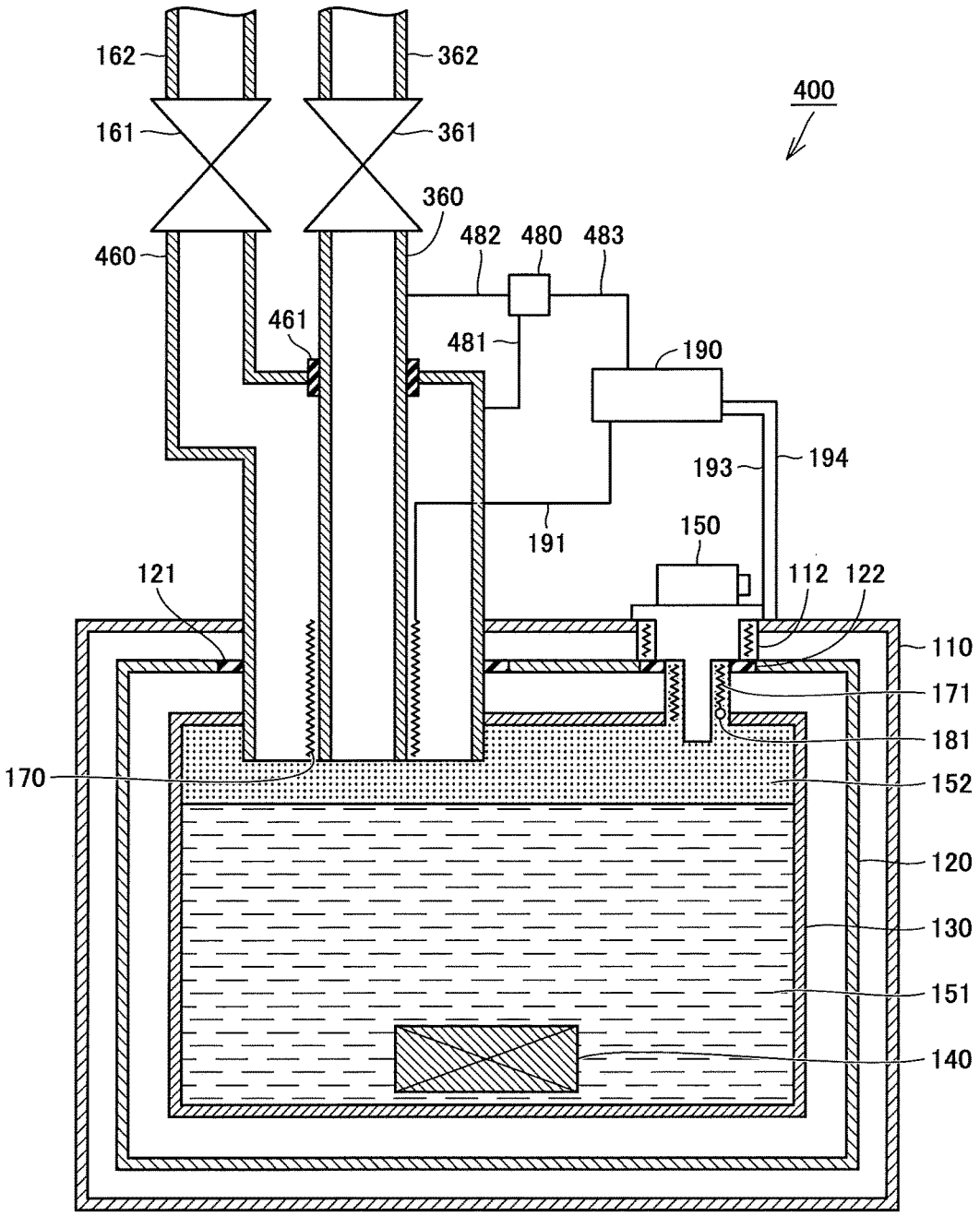
FIG. 4 is a cross-sectional view showing a configuration of a superconducting magnet according to Embodiment 4 of the present invention.

FIG. 4 is a cross-sectional view showing a configuration of a superconducting magnet according to Embodiment 4 of the present invention. FIG. 4 shows a cross section of only the upper part of superconducting magnet 400. In FIG. 4, the components are shown in a simplified form for the sake of simplicity.

As shown in FIG. 4, in superconducting magnet 400 according to Embodiment 4 of the present invention, a portion of second exhaust pipe 360 on the side adjacent to coolant container 130 lies inside a first exhaust pipe 460, with a space lying between the portion and first exhaust pipe 460. A portion of second exhaust pipe 360 on the side opposite to coolant container 130 extends through first exhaust pipe 460 to the outside of vacuum container 110. To a distal end of first exhaust pipe 460, first pressure release valve 161 is connected.

Each of first exhaust pipe 460 and second exhaust pipe 360 is formed of a conductive member. Second exhaust pipe 360 is fixed as being inserted in a ring-shaped fixing member 461 provided at first exhaust pipe 460 and having electrical insulation properties. Thus, first exhaust pipe 460 and second exhaust pipe 360 are electrically insulated from each other at a portion where second exhaust pipe 360 passes through first exhaust pipe 460.

In the present embodiment, first heater 170 is provided along a portion of the inner periphery of first exhaust pipe 160 and the outer periphery of second exhaust pipe 360 lying inside vacuum container 110.

Superconducting magnet 400 further includes a fourth detector 480 having a pair of terminals, one of which is electrically connected to first exhaust pipe 460 and the other of which is electrically connected to second exhaust pipe 360. Fourth detector 480 is disposed outside vacuum container 110.

A first terminal 481 of fourth detector 480 is electrically connected to a portion of first exhaust pipe 460 lying outside vacuum container 110. A second terminal 482 of fourth detector 480 is electrically connected to a portion of second exhaust pipe 360 lying outside vacuum container 110 and outside first exhaust pipe 460. Fourth detector 480 is electrically connected to controller 190 with a seventh line 483.

Fourth detector 480 detects a change in potential difference between first terminal 481 and second terminal 482 due to occurrence of freezing in first exhaust pipe 460. Specifically, fourth detector 480 detects a decrease in potential difference between first terminal 481 and second terminal 482 when a freezing portion generated in first exhaust pipe 460 adheres in such a way as to bridge a space between the inner periphery of first exhaust pipe 460 and the outer periphery of second exhaust pipe 360 and causes a short circuit between first exhaust pipe 460 and second exhaust pipe 360.

Controller 190 causes first heater 170 to work while controller 190 is receiving input of a signal output from fourth detector 480 detecting a decrease in potential difference between first terminal 481 and second terminal 482.

Superconducting magnet 400 according to the present embodiment can melt a freezing portion in first exhaust pipe 460 before the freezing progresses to such an extent as to clog up first exhaust pipe 460. First exhaust pipe 460 can thus be prevented from getting clogged up.

Further, first heater 170 in operation can melt a freezing portion in second exhaust pipe 360 through second exhaust pipe 360. This can prevent second exhaust pipe 360 from getting clogged up without the need for third heater 370 according to Embodiment 3.

The embodiments disclosed herein are illustrative in every respect, and do not serve as a basis for limitative interpretation. Therefore, the technical scope of the present invention should not be interpreted only based on the embodiments described above, but is defined based on the description in the scope of the claims. Further, any modification within the meaning and scope equivalent to the claims is included.

REFERENCE SIGNS LIST

100, 200, 300, 400: superconducting magnet; 110: vacuum container; 461: fixing member; 112: cylinder; 120: radiation shield; 121, 122, 321: thermal anchor; 130: coolant container; 140: superconducting coil; 150: refrigerator; 151: liquid helium; 152: helium gas; 160, 460: first exhaust pipe; 161, 361: pressure release valve; 162: first external pipe; 170: first heater; 171: second heater; 180: first detector; 181: second detector; 190: controller; 191: first line; 192: second line; 193: third line; 194: fourth line; 260: connection pipe; 360: second exhaust pipe; 362: second external pipe; 370: third heater; 380: third detector; 391: fifth line; 392: sixth line; 480: fourth detector; 481: first terminal; 482: second terminal; 483: seventh line

The invention claimed is:

1. A superconducting magnet comprising:

a superconducting coil;

a coolant container containing the superconducting coil in a state where the superconducting coil is immersed in liquid coolant;

a radiation shield surrounding the coolant container;

a vacuum container containing the superconducting coil, the coolant container, and the radiation shield;

a refrigerator configured to cool an inner part of the coolant container and the radiation shield;

a first exhaust pipe connected to the coolant container from outside of the vacuum container and serving as a flow path of the coolant vaporized;

a first pressure release valve connected to a distal end of the first exhaust pipe outside the vacuum container and configured to open when a pressure in the coolant container becomes a first set value or higher;

a heater disposed inside the first exhaust pipe and configured to heat the first exhaust pipe; and a detector provided at the first exhaust pipe and configured to detect a change due to occurrence of freezing in the first exhaust pipe, the detector including a pair of terminals disposed inside the first exhaust pipe, the change being a change in potential difference between the terminals of the pair.

2. The superconducting magnet according to claim 1, the superconducting magnet further comprising a controller electrically connected to each of the heater and the detector, wherein the controller is configured to cause the heater to work while the controller is receiving input of a signal output from the detector detecting the change.

3. The superconducting magnet according to claim 2, wherein the heater is provided along an inner periphery of the first exhaust pipe.

4. The superconducting magnet according to claim 1, wherein the heater is provided along an inner periphery of the first exhaust pipe.

5. A superconducting magnet comprising:

a superconducting coil;

a coolant container containing the superconducting coil in a state where the superconducting coil is immersed in liquid coolant;

a radiation shield surrounding the coolant container;

a vacuum container containing the superconducting coil, the coolant container, and the radiation shield;

a refrigerator configured to cool an inner part of the coolant container and the radiation shield;

a first exhaust pipe connected to the coolant container from outside of the vacuum container and serving as a flow path of the coolant vaporized;

a first pressure release valve connected to a distal end of the first exhaust pipe outside the vacuum container and configured to open when a pressure in the coolant container becomes a first set value or higher;

a heater disposed inside the first exhaust pipe and configured to heat the first exhaust pipe; and a detector provided at the first exhaust pipe and configured to detect a change due to occurrence of freezing in the first exhaust pipe;

a second exhaust pipe extending from outside of the vacuum container through to inside of the coolant container and serving as a flow path of the coolant vaporized; and a second pressure release valve connected to a distal end of the second exhaust pipe outside the vacuum container and configured to open when a pressure in the coolant container becomes a second set value or higher, the second set value being higher than the first set value, a portion of the second exhaust pipe on a side adjacent to the coolant container lying inside the first exhaust pipe, with a space lying between the portion and the first exhaust pipe, a portion of the second exhaust pipe on a side opposite to the coolant container extending through the first exhaust pipe to outside of the vacuum container, each of the first exhaust pipe and the second exhaust pipe being formed of a conductive member, the first exhaust pipe and the second exhaust pipe being electrically insulated from each other at a portion where the second exhaust pipe passes through the first exhaust pipe, the detector including a pair of terminals, one of the terminals being electrically connected to the first exhaust pipe, the other of the terminals being electrically connected to the second exhaust pipe, the change being a change in potential difference between the terminals of the pair.

6. The superconducting magnet according to claim 5, the superconducting magnet further comprising a controller electrically connected to each of the heater and the detector, wherein the controller is configured to cause the heater to work while the controller is receiving input of a signal output from the detector detecting the change.

7. The superconducting magnet according to claim 6, wherein the heater is provided along an inner periphery of the first exhaust pipe.

8. The superconducting magnet according to claim 5, wherein the heater is provided along an inner periphery of the first exhaust pipe.

9. A superconducting magnet comprising:

a superconducting coil;

a coolant container containing the superconducting coil in a state where the superconducting coil is immersed in liquid coolant;

a radiation shield surrounding the coolant container;

a vacuum container containing the superconducting coil, the coolant container, and the radiation shield;

a refrigerator configured to cool an inner part of the coolant container and the radiation shield;

a first exhaust pipe connected to the coolant container from outside of the vacuum container and serving as a flow path of the coolant vaporized;

a first pressure release valve connected to a distal end of the first exhaust pipe outside the vacuum container and configured to open when a pressure in the coolant container becomes a first set value or higher;

a heater disposed inside the first exhaust pipe and configured to heat the first exhaust pipe; and a detector provided at the first exhaust pipe and configured to detect a change due to occurrence of freezing in the first exhaust pipe in a state where the first exhaust pipe is not clogged up.

10. The superconducting magnet according to claim 9, the superconducting magnet further comprising a controller electrically connected to each of the heater and the detector, wherein the controller is configured to cause the heater to work while the controller is receiving input of a signal output from the detector detecting the change.

11. The superconducting magnet according to claim 10, wherein the heater is provided along an inner periphery of the first exhaust pipe.

12. The superconducting magnet according to claim 9, wherein the heater is provided along an inner periphery of the first exhaust pipe.

* * * * *